US011669035B2

(12) United States Patent
Lin

(10) Patent No.: US 11,669,035 B2
(45) Date of Patent: Jun. 6, 2023

(54) IMAGE FORMING DEVICE AND MEDIUM DETECTING MECHANISM THEREOF

(71) Applicant: AVISION INC., Hsinchu (TW)

(72) Inventor: Chia-Ching Lin, Hsinchu (TW)

(73) Assignee: AVISION INC., Hsinchu (TW)

( * ) Notice: Subject to any disclaimer, the term of this patent is extended or adjusted under 35 U.S.C. 154(b) by 179 days.

(21) Appl. No.: 17/170,804

(22) Filed: Feb. 8, 2021

(65) Prior Publication Data

US 2021/0263460 A1 Aug. 26, 2021

(30) Foreign Application Priority Data

Feb. 26, 2020 (TW) ..... 109106148

(51) Int. Cl.
*G03G 15/00* (2006.01)

(52) U.S. Cl.
CPC ..... *G03G 15/553* (2013.01); *B65H 2553/41* (2013.01); *G03G 15/607* (2013.01); *G03G 2215/00616* (2013.01); *G03G 2215/00725* (2013.01)

(58) Field of Classification Search
CPC ..... G03G 15/553; G03G 15/607; G03G 2215/00616; G03G 2215/00725; B65H 2553/41
See application file for complete search history.

(56) References Cited

U.S. PATENT DOCUMENTS

| | | | | |
|---|---|---|---|---|
| 5,897,112 | A * | 4/1999 | Kwag | G03G 15/6502 271/38 |
| 5,932,864 | A | 8/1999 | Kawabuchi | |
| 6,462,839 | B1 | 10/2002 | Short | |
| 10,106,347 | B2 | 10/2018 | Lin | |
| 2007/0064252 | A1 | 3/2007 | Iwago | |
| 2014/0063574 | A1 | 3/2014 | Uchida | |
| 2014/0353907 | A1* | 12/2014 | Hara | B65H 1/266 271/171 |

(Continued)

FOREIGN PATENT DOCUMENTS

| | | | |
|---|---|---|---|
| CN | 101070123 | A | 11/2007 |
| CN | 105245755 | A | 1/2016 |

(Continued)

*Primary Examiner* — Yaovi M Ameh
*Assistant Examiner* — Quang X Nguyen
(74) *Attorney, Agent, or Firm* — Winston Hsu

(57) ABSTRACT

An image forming device includes a casing and a medium detecting mechanism. A medium entrance is formed on the casing. The medium detecting mechanism includes a detector, a first pivoting component, a second pivoting component and a resilient component. When at least one medium enters into the medium entrance and abuts against the first pivoting component, the at least one medium drives the first pivoting component to pivot in a first pivoting direction, so that the second pivoting component is driven by the resilient component to pivot in the first pivoting direction to actuate the detector for generating a signal. When the second pivoting component is stopped from pivoting in the first pivoting direction, deformation of the resilient component allows the first pivoting component to be driven by the at least one medium to pivot relative to the second pivoting component in the first pivoting direction continuously.

20 Claims, 12 Drawing Sheets

(56) References Cited

U.S. PATENT DOCUMENTS

2015/0307311 A1* 10/2015 Ono ..... G03G 15/6552
271/176

FOREIGN PATENT DOCUMENTS

| | | | |
|---|---|---|---|
| CN | 206985229 | U | 2/2018 |
| CN | 108238464 | B | 12/2019 |
| TW | I628083 | B | 7/2018 |

* cited by examiner

IMAGE FORMING DEVICE AND MEDIUM DETECTING MECHANISM THEREOF

BACKGROUND OF THE DISCLOSURE

1. Field of the Disclosure

The present invention relates to an image forming device and a medium detecting mechanism thereof, and more specifically, to an image forming device capable of detecting a large amount of media and a medium detecting mechanism.

2. Description of the Prior Art

Image forming devices, such as scanners or printers, are widely used in families or offices for bringing convenience in people's lives. The image forming device includes a detecting mechanism at a medium entrance for detecting at least one medium, such as paper, to provide a notification to remind a user of replenishment of at least one printing medium when the at least one printing medium runs out or to inform the user of scanning completion when finishing delivery of at least one scanning medium. The conventional detecting mechanism usually includes a detector and a moving component. The moving component can be driven by the at least one medium to actuate the detector for allowing the detector to generate a corresponding signal. However, a moving range of the moving component is restricted by an internal mechanical space of the image forming device, which only allows a user to place a small amount of media at the medium entrance. When the user places an excessively large amount of media at the medium entrance, the moving component may interfere with another structure, so that the moving component cannot work normally. If a printing operation or a scanning operation requires a large amount of media, the operation needs to be divided into multiple stages, which is not convenient in use.

SUMMARY OF THE DISCLOSURE

Therefore, it is an objective of the present invention to provide an image forming device capable of detecting a large amount of media and a medium detecting mechanism for solving the aforementioned problem.

In order to achieve the aforementioned objective, the present invention discloses an image forming device capable of detecting at least one medium. The image forming device includes a casing and a medium detecting mechanism. A medium entrance is formed on the casing. The medium detecting mechanism is disposed adjacent to the medium entrance. The medium detecting mechanism includes a detector, a first pivoting component, a second pivoting component and a resilient component. The detector is disposed inside the casing. The first pivoting component is pivotally disposed on the casing. The first pivoting component includes an abutting end for abutting against the at least one medium entering into the medium entrance. The second pivoting component is movably sleeved on the first pivoting component. The second pivoting component includes a detecting end fixedly connected to a body of the second pivoting component and for actuating the detector to generate a signal. The resilient component is connected to the first pivoting component and the second pivoting component. When the at least one medium enters into the medium entrance and abuts against the abutting end, the at least one medium drives the first pivoting component to pivot in a first pivoting direction. When the first pivoting component pivots in the first pivoting direction, the first pivoting component drives the second pivoting component to pivot in the first pivoting direction by the resilient component to drive the detecting end of the second pivoting component to move in the first pivoting direction, so that the detecting end of the second pivoting component moving in the first pivoting direction actuates the detector for generating the signal, and when the detecting end of the second pivoting component is stopped from continuously pivoting in the first pivoting direction, resilient deformation of the resilient component allows the first pivoting component to be driven by the at least one medium to continuously pivot in the first pivoting direction relative to the second pivoting component.

According to an embodiment of the present invention, a first connecting lug is formed on the first pivoting component. A second connecting lug is formed on the second pivoting component, and the resilient component is connected to the first connecting lug and the second connecting lug.

According to an embodiment of the present invention, a restraining protrusion is formed on the first pivoting component. A restraining slot is formed on the second pivoting component, and the restraining protrusion is movably located in the restraining slot for restraining a pivoting angle of the first pivoting component relative to the second pivoting component.

According to an embodiment of the present invention, the restraining slot includes a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

According to an embodiment of the present invention, a stopping structure protrudes from the detecting end. The second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

In order to achieve the aforementioned objective, the present invention further discloses a medium detecting mechanism disposed adjacent to a medium entrance formed on a casing of an image forming device. The medium detecting mechanism includes a detector, a first pivoting component, a second pivoting component and a resilient component. The detector is disposed inside the casing. The first pivoting component is pivotally disposed on the casing. The first pivoting component includes an abutting end for abutting against the at least one medium entering into the medium entrance. The second pivoting component is movably sleeved on the first pivoting component. The second pivoting component includes a detecting end fixedly connected to a body of the second pivoting component and for actuating the detector to generate a signal. The resilient component is connected to the first pivoting component and the second pivoting component. When the at least one medium enters into the medium entrance and abuts against the abutting end, the at least one medium drives the first pivoting component to pivot in a first pivoting direction.

When the first pivoting component pivots in the first pivoting direction, the first pivoting component drives the second pivoting component to pivot in the first pivoting direction by the resilient component to drive the detecting end of the second pivoting component to move in the first pivoting direction, so that the detecting end of the second pivoting component moving in the first pivoting direction actuates the detector for generating the signal, and when the detecting end of the second pivoting component is stopped from continuously pivoting in the first pivoting direction, resilient deformation of the resilient component allows the first pivoting component to be driven by the at least one medium to continuously pivot in the first pivoting direction relative to the second pivoting component.

According to an embodiment of the present invention, a first connecting lug is formed on the first pivoting component. A second connecting lug is formed on the second pivoting component, and the resilient component is connected to the first connecting lug and the second connecting lug.

According to an embodiment of the present invention, a restraining protrusion is formed on the first pivoting component. A restraining slot is formed on the second pivoting component, and the restraining protrusion is movably located in the restraining slot for restraining a pivoting angle of the first pivoting component relative to the second pivoting component.

According to an embodiment of the present invention, the restraining slot includes a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

According to an embodiment of the present invention, a stopping structure protrudes from the detecting end. The second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

In summary, in the present invention, when the at least one medium enters into the medium entrance and abuts against the abutting end of the first pivoting component, the at least one medium drives the first pivoting component to pivot in the first pivoting direction to drive the second pivoting component to pivot in the first pivoting component by the resilient component for allowing the detecting end of the second pivoting component to actuate the detector to generate the signal. When the detecting end of the second pivoting component is stopped from continuously pivoting in the first pivoting direction, the resilient deformation of the resilient component allows the first pivoting component to be driven by the at least one medium to continuously pivot in the first pivoting direction relative to the second pivoting component. Therefore, the present invention can solve a problem of structural interference in the prior art and allow a user to place a large amount of the media at the medium entrance for preventing a multi-stage scanning operation or a multi-stage printing operation.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" is intended to mean either an indirect or direct electrical/mechanical connection. Thus, if a first device is connected to a second device, that connection may be through a direct electrical/mechanical connection, or through an indirect electrical/mechanical connection via other devices and connections.

Figure 1:
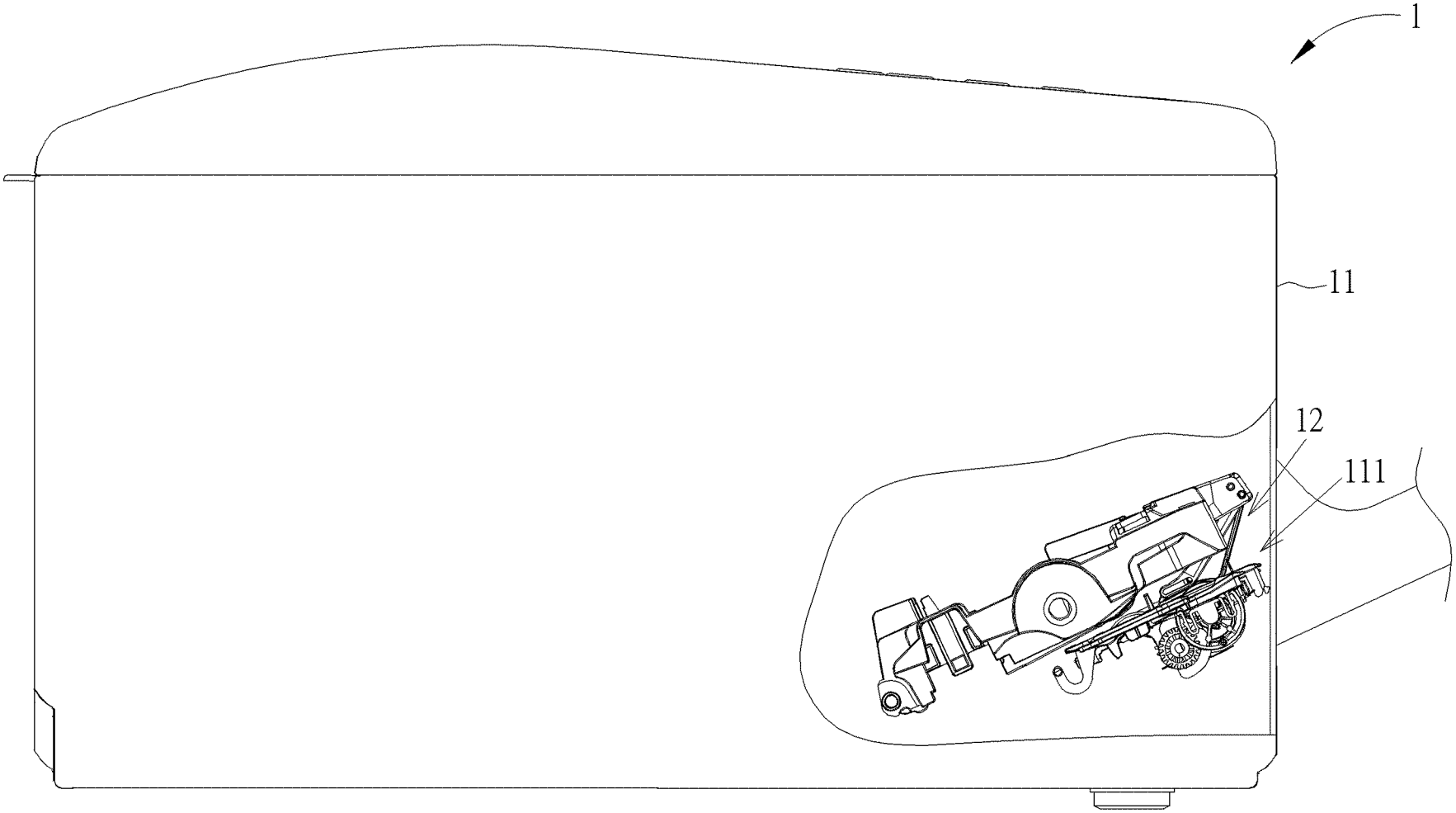
FIG. 1 is a partial diagram of an image forming device according to an embodiment of the present invention.
Figure 2:
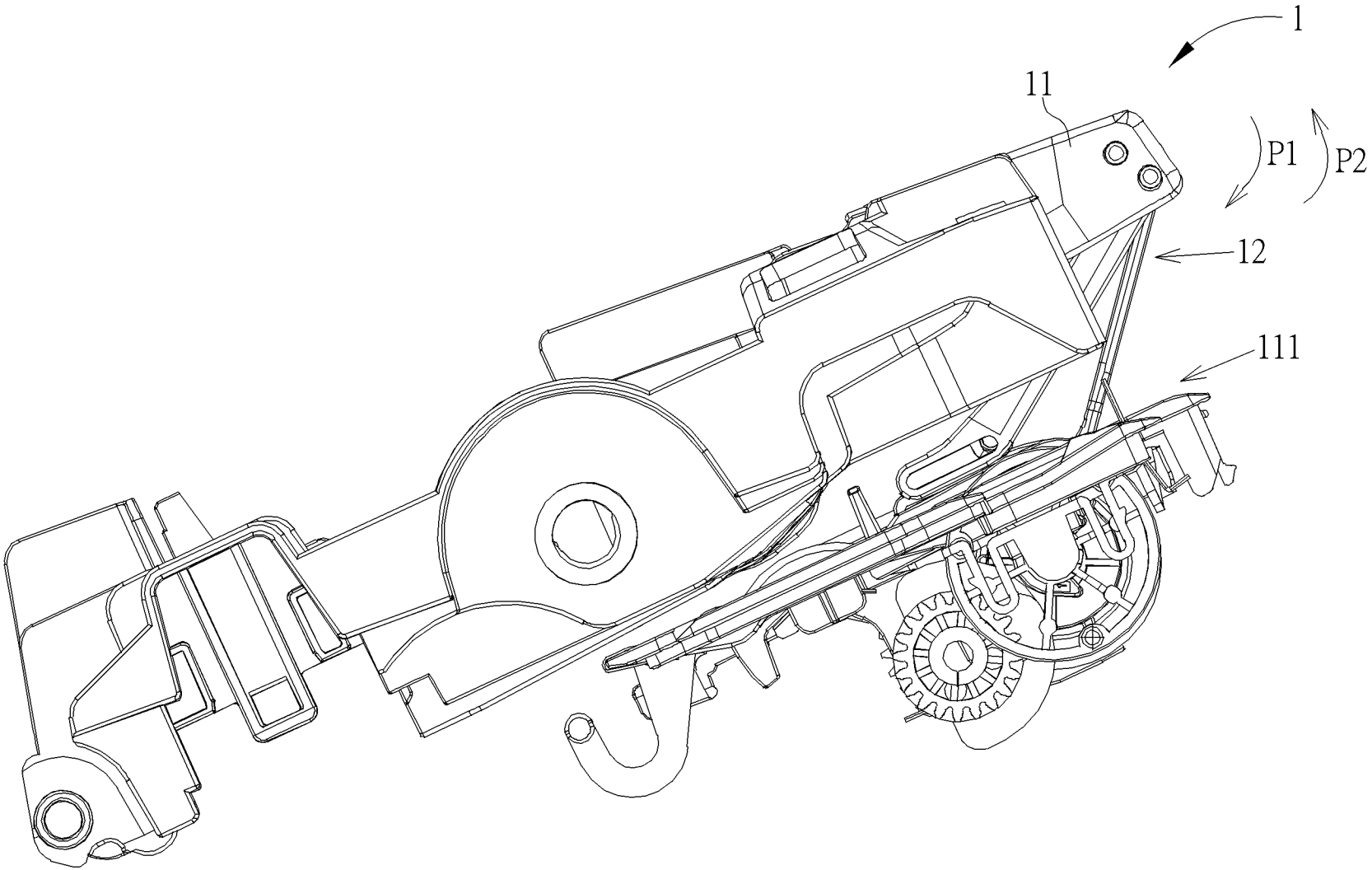
FIG. 2 and FIG. 3 are partial enlarged diagrams of the image forming device at different views according to the embodiment of the present invention.
Figure 3:
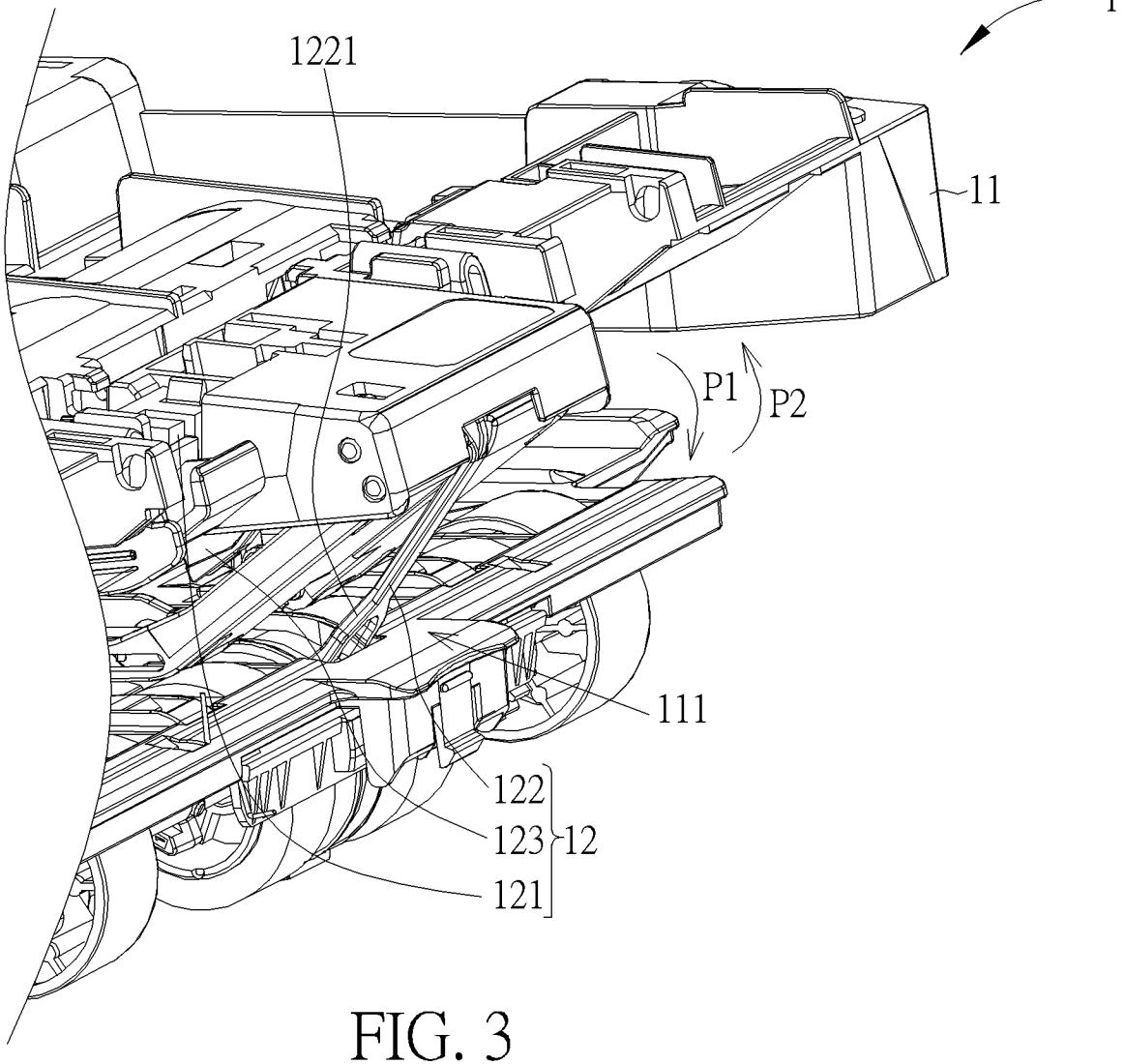
Figure 4:
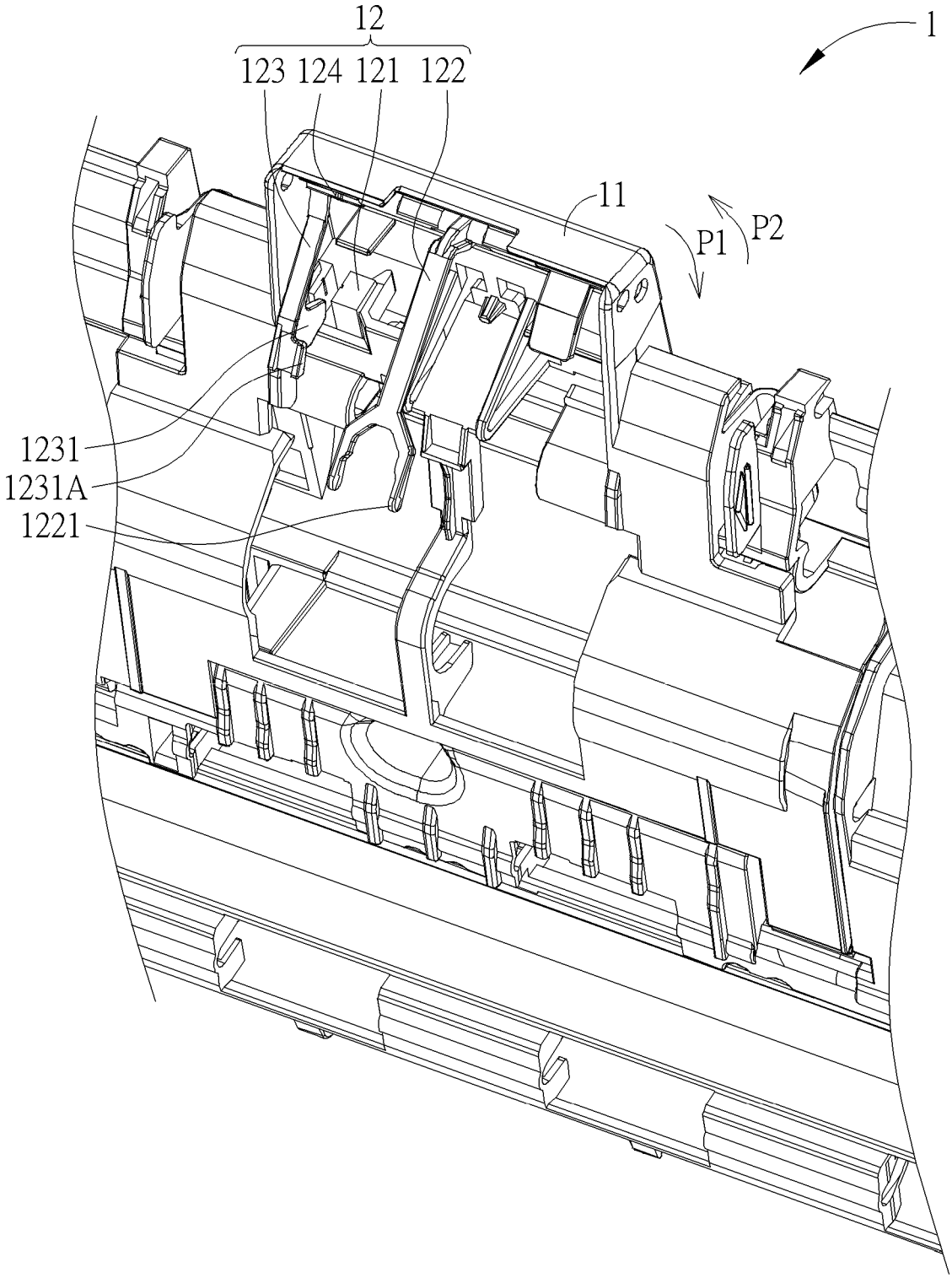
FIG. 4 is another enlarged diagram of the image forming device according to the embodiment of the present invention.
Figure 5:
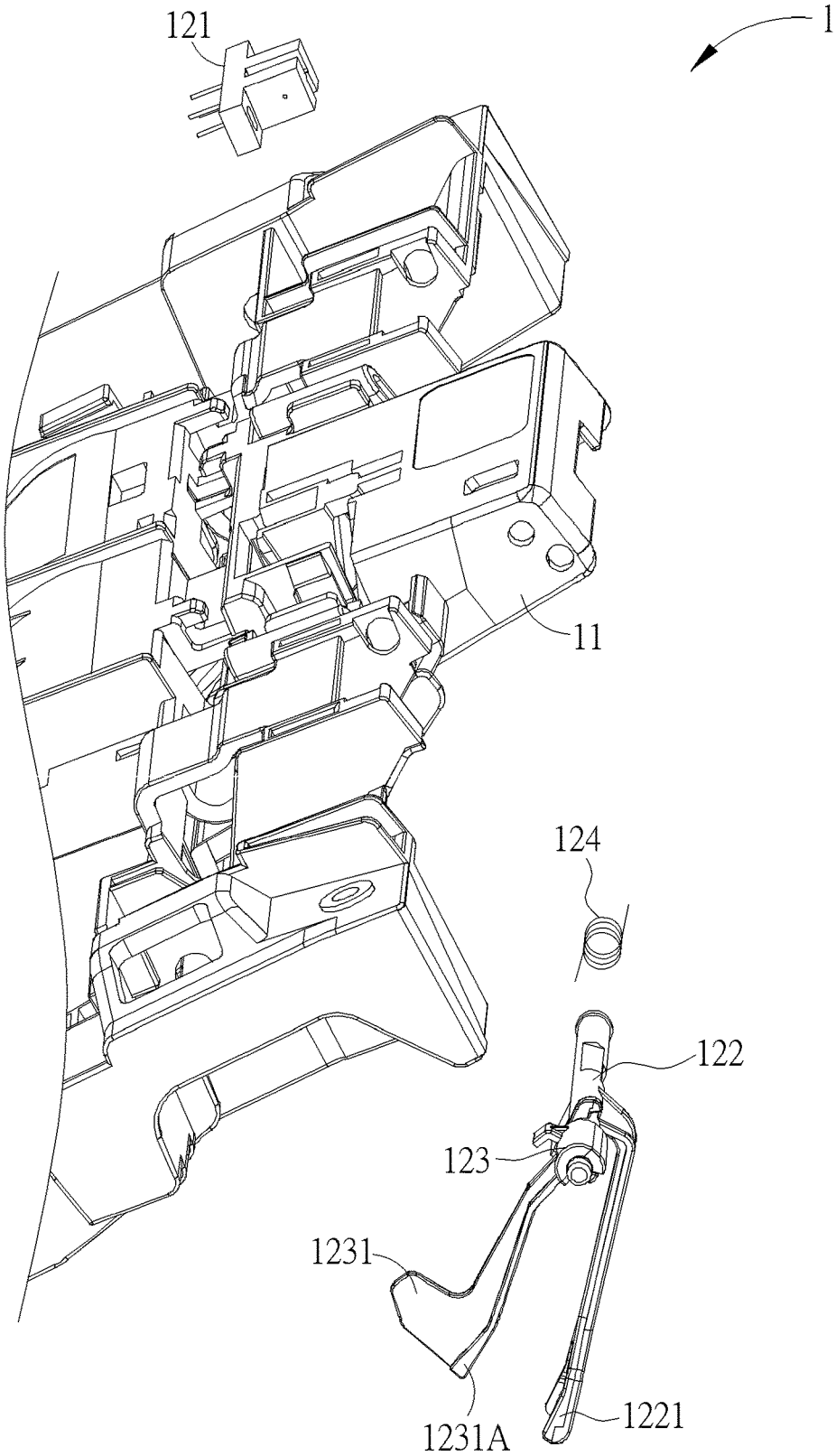
FIG. 5 is a partial exploded diagram of the image forming device according to the embodiment of the present invention.

Please refer to FIG. 1 to FIG. 5. FIG. 1 is a partial diagram of an image forming device 1 according to an embodiment of the present invention. FIG. 2 and FIG. 3 are partial enlarged diagrams of the image forming device 1 at different views according to the embodiment of the present invention. FIG. 4 is another enlarged diagram of the image forming device 1 according to the embodiment of the present invention. FIG. 5 is a partial exploded diagram of the image forming device 1 according to the embodiment of the present invention. As shown in FIG. 1 to FIG. 5, the image forming device 1 includes a casing 11 and a medium detecting mechanism 12. In order to illustrate structure and operational principle of the present invention, FIG. 2 to FIG. 5 only show a part of the casing 11 whereon the medium detecting mechanism 12 is disposed, instead of the entire casing 11. A medium entrance 111 is formed on the casing 11 and for allowing at least one medium, such as paper, to enter into the interior of the image forming device 1, and the medium detecting mechanism 12 is disposed adjacent to the medium entrance 111.

The medium detecting mechanism 12 includes a detector 121, a first pivoting component 122, a second pivoting component 123 and a resilient component 124. The detector 121 is disposed on the casing 11. The first pivoting component 122 is pivotally disposed on the casing 11. The first pivoting component 122 includes an abutting end 1221 for abutting against the at least one medium entering into the medium entrance 111. The second pivoting component 123 is movably sleeved on the first pivoting component 122. The second pivoting component 123 includes a detecting end 1231 for actuating the detector 121 to generate a signal. The signal can be a signal which indicates that the at least one medium enters into the medium entrance 111. For example, in an embodiment, the detector can be a light interruption detector, and the detecting end can interrupt light emitted from the light interruption detector to allow the light interruption detector to generate a corresponding signal. Alternatively, in another embodiment, the detector also can be a light reflection detector, and the detecting end can reflect light emitted from the light reflection detector back to the light reflection detector, so as to allow the light reflection detector to generate a corresponding signal. Furthermore, in this embodiment, the abutting end 1221 can preferably be formed in a Y-shaped structure. However, the present invention is not limited to this embodiment. It depends on practical demands.

The resilient component 124 can be a spring and connected to the first pivoting component 122 and the second pivoting component 123. When the at least one medium enters into the medium entrance 111 and abuts against the abutting end 1221, the at least one medium drives the first pivoting component 122 to pivot in a first pivoting direction P1 for driving the second pivoting component 123 by the resilient component 124 to pivot in the first pivoting direction R1, so that the detecting end 1231 of the second pivoting component 123 can actuate the detector 121 to generate the signal. When the detecting end 1231 of the second pivoting component 123 is stopped from continuously pivoting in the first pivoting direction P1, resilient deformation of the resilient component 124 allows the first pivoting component 122 to be driven by the at least one medium to continuously pivot in the first pivoting direction P1 relative to the second pivoting component 123. When there is no medium entering into the medium entrance 111, the first pivoting component 122 and the second pivoting component 123 can be located at positions as shown in FIG. 2 and FIG. 3 by the resilient component 124 and gravity. At this moment, the detecting end 1231 does not actuate the detector 121, so that the detector 121 can generate no signal or another signal which indicates that no medium enters into the medium entrance 111.

Preferably, in this embodiment, the detector 121 can be a light interruption detector and includes an emitting portion and a receiving portion which are opposite to each other. When the at least one medium enters into the medium entrance 111 and abuts against the abutting end 1221, the at least one medium drives the first pivoting component 122 to pivot in the first pivoting direction P1 for driving the second pivoting component 123 by the resilient component 124 to pivot in the first pivoting direction P1 to move the detecting end 1231 of the second pivoting component 123 to be located between the emitting portion and the receiving portion of the light interruption detector, so that the detecting end 1231 of the second pivoting component 123 can interrupt the light emitted from the emitting portion to prevent the receiving portion from receiving the light emitted from the emitting portion. At this moment, the light interruption detector can generate a light interruption signal which indicates that the at least one medium enters into the medium entrance 111. When there is no medium entering into the medium entrance 111, the first pivoting component 122 and the second pivoting component 123 can be located at positions as shown in FIG. 2 and FIG. 3 by the resilient component 124 and gravity. At this moment, the detecting end 1231 is located away from the emitting portion and the receiving portion of the light interrupt detector, and the receiving portion can receive the light emitted from the emitting portion, so that the detector 121 can generate no signal or a light receiving signal which indicates that no medium enters into the medium entrance 111. However, the present invention is not limited to this embodiment. For example, in another embodiment, the detector can be a light reflection detector and includes an emitting portion and a receiving portion which are located at a same side. The detecting end can reflect the light emitted from the emitting portion to the receiving portion, so that the receiving portion can generate a corresponding signal. When the at least one medium enters into the medium entrance and abuts against the abutting end, the at least one medium drives the first pivoting component to pivot in the first pivoting direction for driving the second pivoting component by the resilient component to pivot in the first pivoting direction to move the detecting end of the second pivoting component to allow the detecting end to reflect the light emitted from the emitting portion to the receiving portion, so that the light reflection detector can generate a light reflection signal which indicates that the at least one medium enters into the medium entrance. When there is no medium entering into the medium entrance, the detecting end is located away from the emitting portion and the receiving portion of the light reflection detector. At this moment, the receiving portion cannot receive the light emitted from the emitting portion, so that the light reflection detector can generate no signal or a signal which indicates that no medium enters into the medium entrance. Besides, in another embodiment, the detector can be a magnetic sensor or a proximity switch. Furthermore, in this embodiment, the resilient component 124 can be a torsional spring. However, the present invention is not limited to this embodiment. For example, in another embodiment, the resilient component can be an extension spring or a leaf spring.

Figure 6:
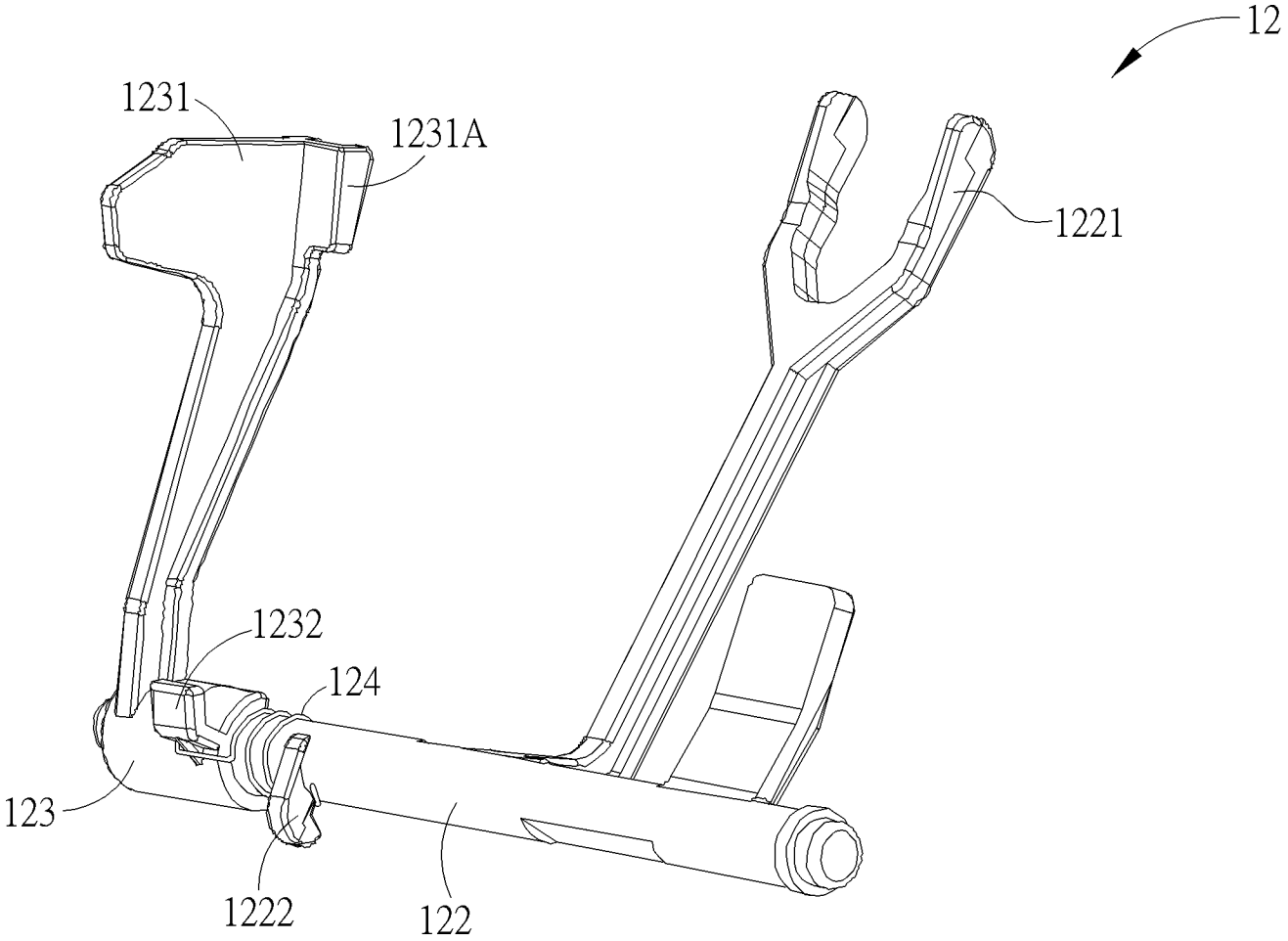
FIG. 6 to FIG. 8 are diagrams of partial structure of a medium detecting mechanism at different views according to the embodiment of the present invention.
Figure 7:
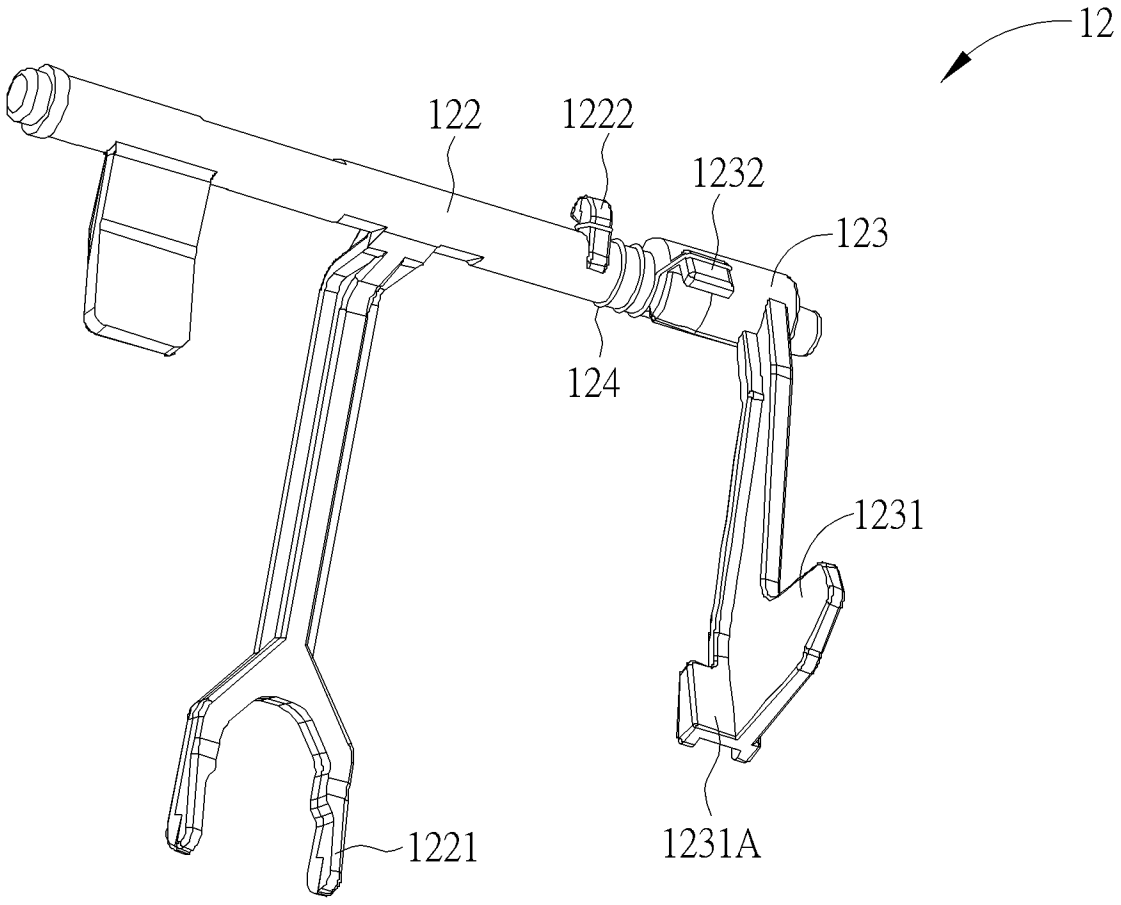
Figure 8:
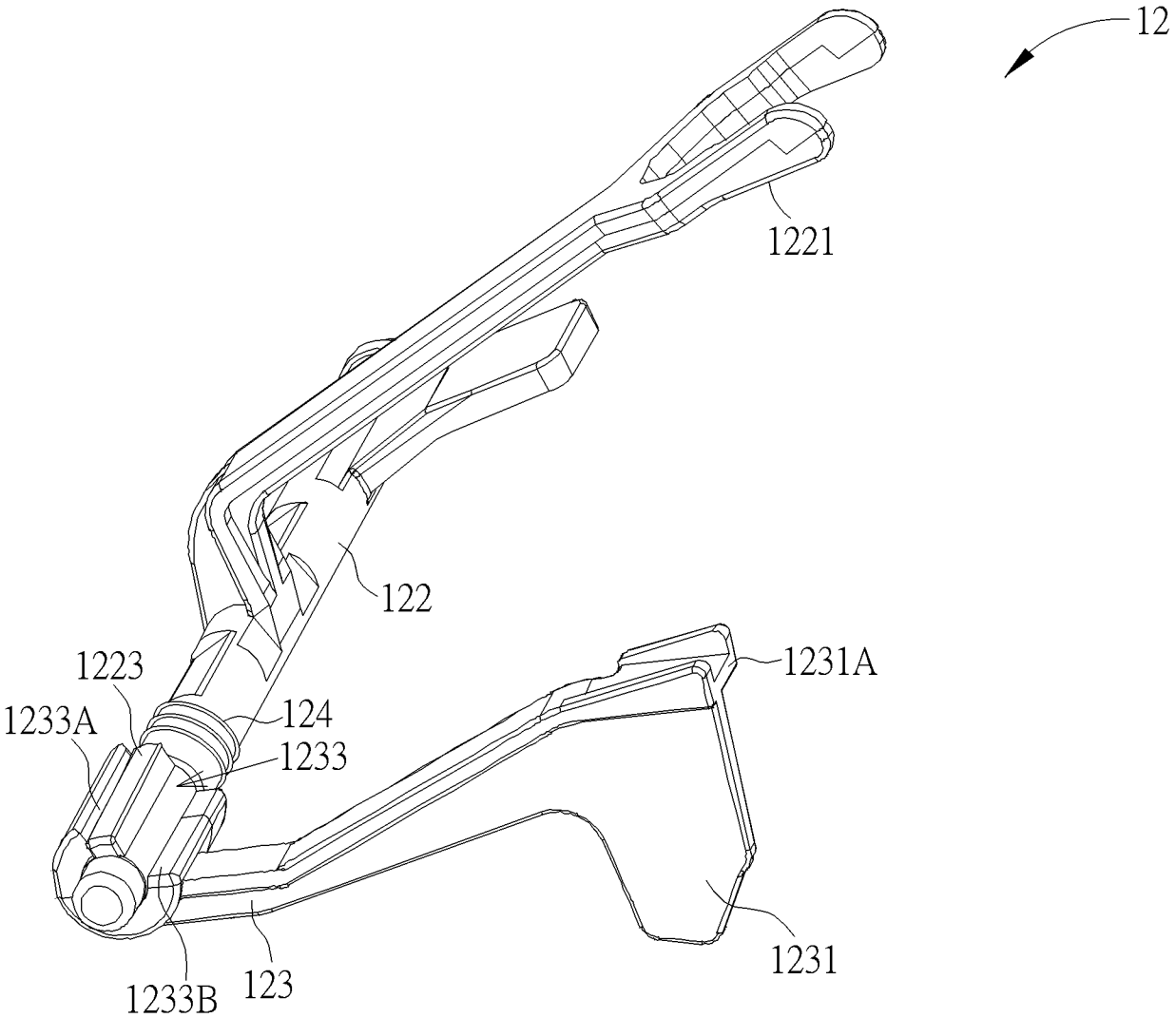

Please refer to FIG. 6 to FIG. 8. FIG. 6 to FIG. 8 are diagrams of partial structure of the medium detecting mechanism 12 at different views according to the embodiment of the present invention. As shown in FIG. 6 to FIG. 8, specifically, in order to connect the resilient component 124 to the first pivoting component 122 and the second pivoting component 123, in this embodiment, a first connecting lug 1222 is formed on the first pivoting component 122, and a second connecting lug 1232 is formed on the second pivoting component 123. Two ends of the resilient component 124 are respectively connected to the first connecting lug 1222 and the second connecting lug 1232. Furthermore, in order to stop the second pivoting component 123 from continuously pivoting in the first pivoting direction P1 after being driven to pivot by a predetermined angle in the first pivoting direction P1 by the first pivoting component 122, a stopping structure 1231A protrudes from the detecting end 1231. When the second pivoting component 123 pivots by the predetermined angle in the first pivoting direction P1, the stopping structure 1231A can abut against the detector 121, so that the second pivoting component 123 cannot continuously pivot in the first pivoting direction P1. Furthermore, in other to restrain a pivoting angle of the first pivoting component 122 relative to the second pivoting component 123 to prevent the first pivoting component 122 from interfering with another component due to the excessive pivoting angle, a restraining protrusion 1223 is formed on the first pivoting component 122, and a restraining slot 1233 is formed on the second pivoting component 123. The restraining protrusion 1223 is movably located in the restraining slot 1233. The restraining slot 1233 includes a first restraining wall 1233A and a second restraining wall 1233B. When the first pivoting component 122 pivots in the first pivoting direction P1 relative to the second pivoting component 123 by the resilient deformation of the resilient component 124, the restraining protrusion 1223 leaves from the first restraining wall 1233A and moves toward the second restraining wall 1233B.

However, the structures of the first pivoting component and the second pivoting component are not limited to this embodiment. It depends on practical demands. In other words, any mechanism which allows the first pivoting component to drive the second pivoting component to pivot in the first pivoting direction together with the first pivoting component when the first pivoting component pivots in the first pivoting component and the second pivoting component is not stopped, is included within the scope of the present invention. For example, in another embodiment, the first connecting lug, the second connecting lug, the restraining protrusion, the restraining slot or the stopping structure can be selectively omitted.

Figure 9:
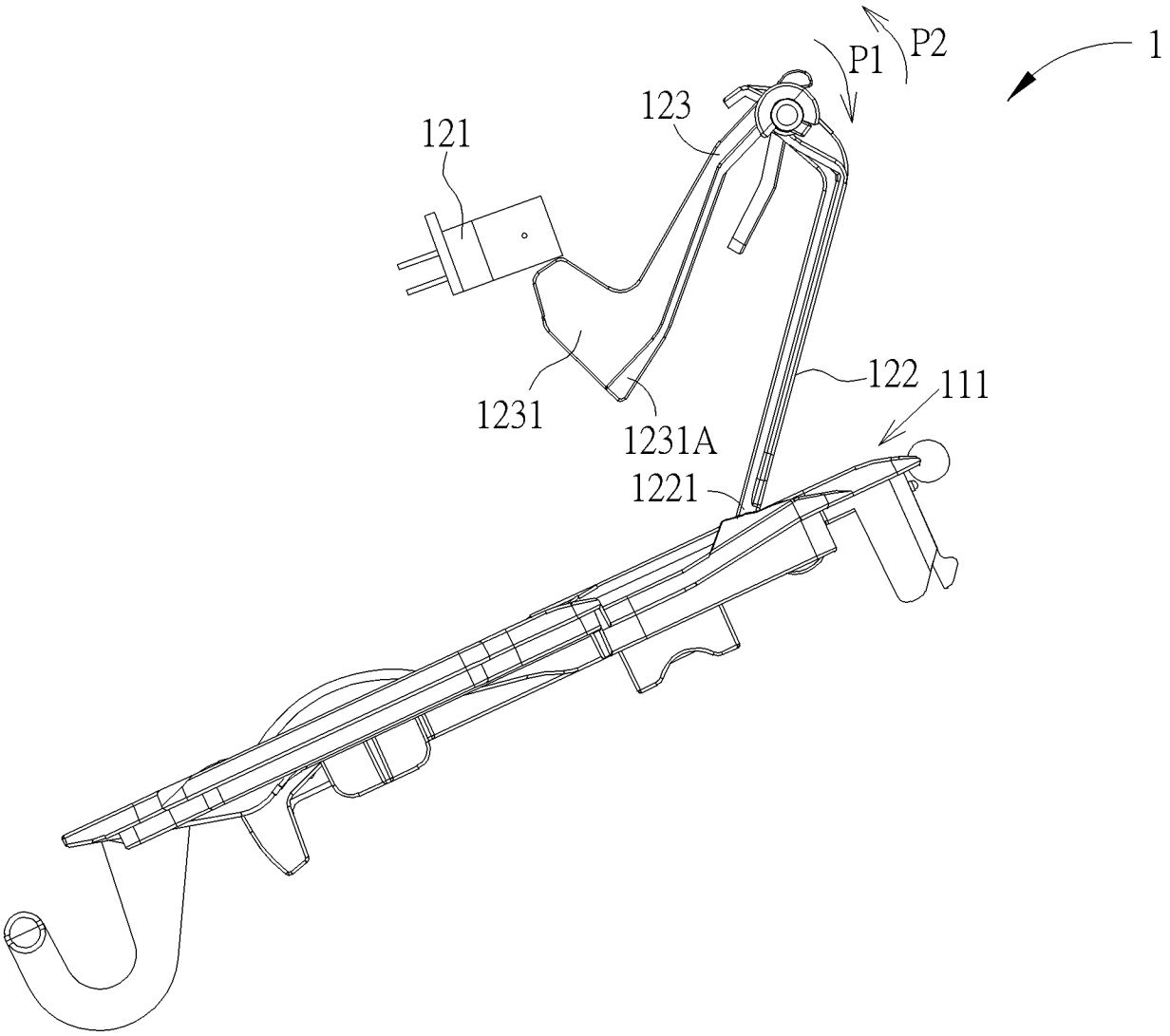
FIG. 9 to FIG. 12 are diagrams of partial structure of the image forming device in different states according to the embodiment of the present invention.
Figure 10:
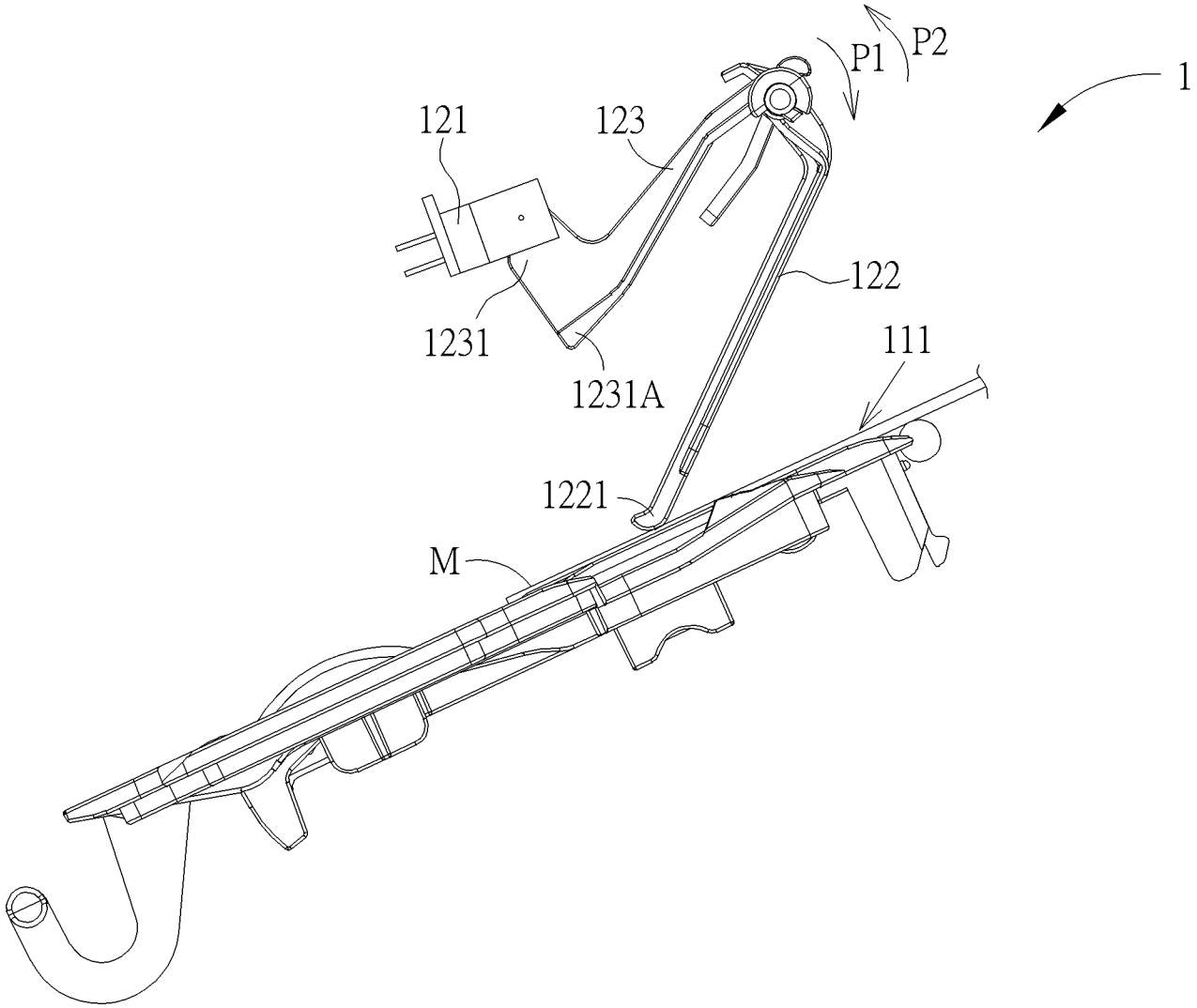
Figure 11:
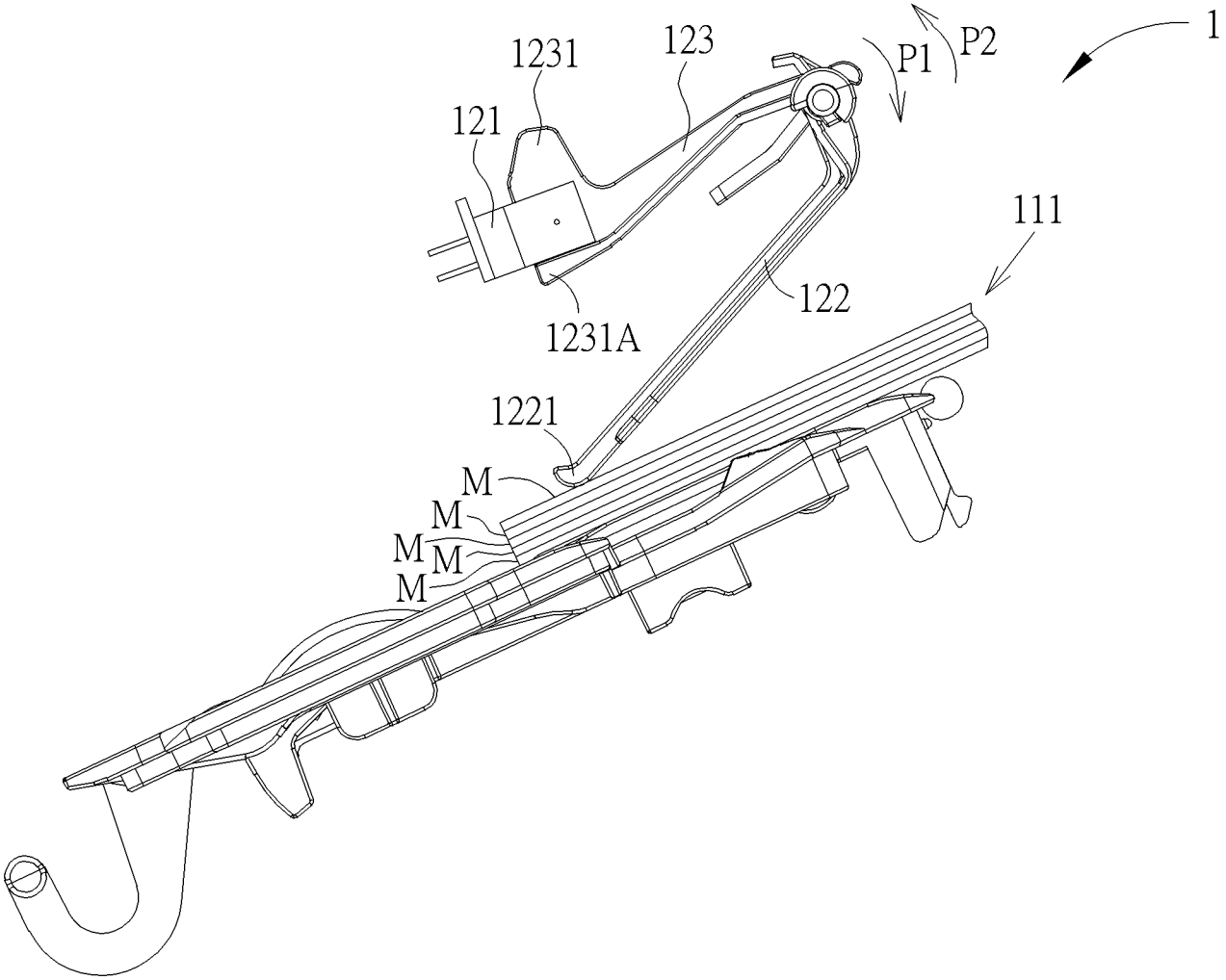
Figure 12:
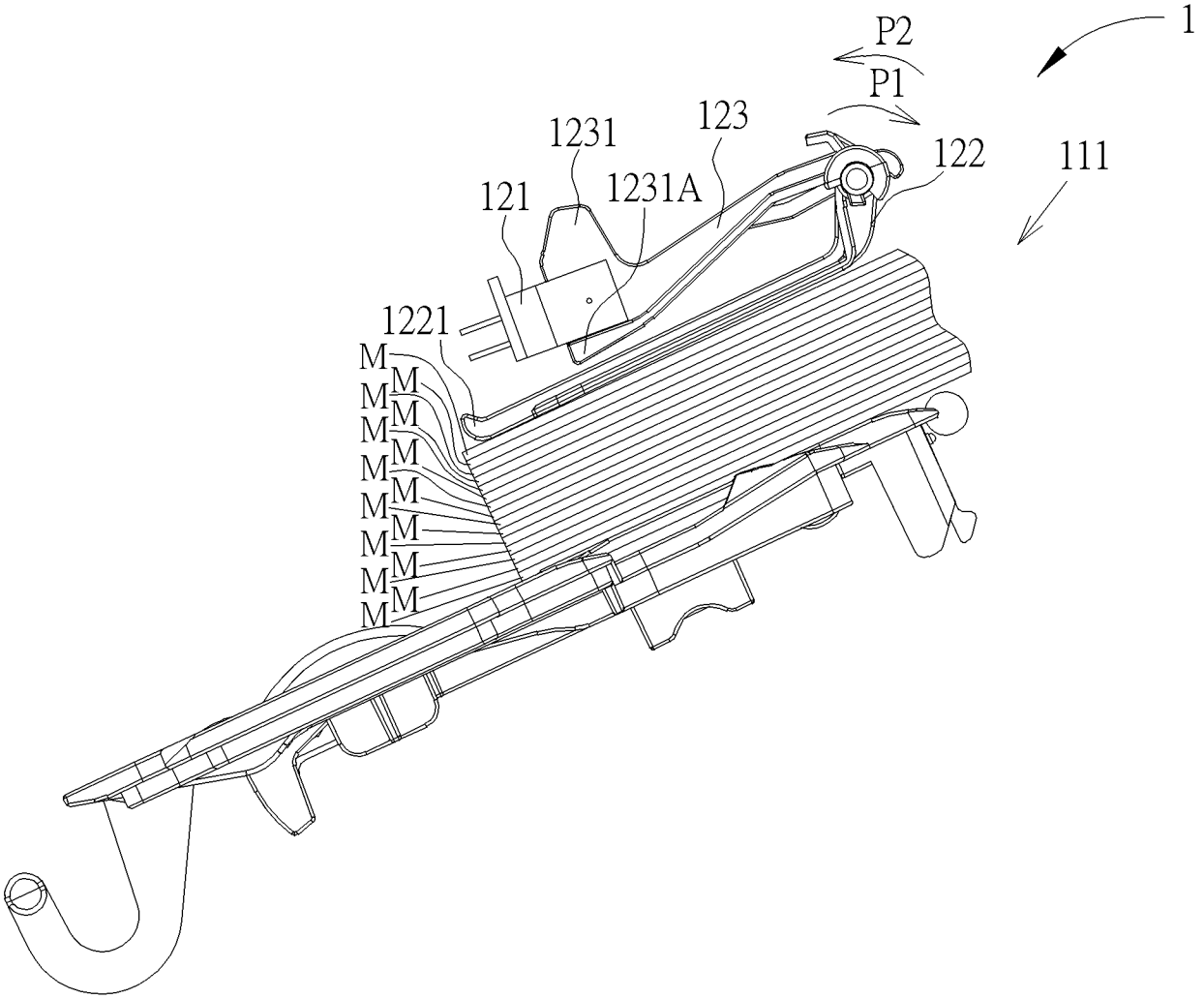

Please refer to FIG. 9 to FIG. 12. FIG. 9 to FIG. 12 are diagrams of partial structure of the image forming device 1 in different states according to the embodiment of the present invention. When there is no medium entering into the medium entrance 111, the first pivoting component 122 and the second pivoting component 123 can be respectively located at a first initial position and a second initial position as shown in FIG. 9 by the resilient component 124 and gravity. At this moment, the detecting end 1231 does not actuate the detector 121, so that the detector 121 can generate no signal or a signal which indicates that no medium enters into the medium entrance 111. When there is one medium M entering into the medium entrance 111, the medium M can drive the first pivoting component 122 to pivot to a first raised position as shown in FIG. 10 for driving the second pivoting component 123 by the resilient component 124 to pivot to a second raised position as shown in FIG. 10 in the first pivoting direction P1, so that the detecting end 1231 of the second pivoting component 123 can actuate the detector 121 to allow the detector 121 to generate a signal which indicates that the medium M enters into the medium entrance 111. When there is a small amount of media M entering into the medium entrance 111, the media M can drive the first pivoting component 122 to pivot to a third raised position as shown in FIG. 11 for driving the second pivoting component 123 by the resilient component 124 to pivot to a fourth raised position as shown in FIG. 11 in the first pivoting direction P1, so that the detecting end 1231 of the second pivoting component 123 can actuate the detector 121 to generate a signal which indicates that the small amount of medium M enter into the medium entrance 111. It should be noticed that, at this moment, the stopping structure 1231A abuts against the detector 121, so that the second pivoting component 123 cannot continuously pivot in the first pivoting direction P1. When there is a large amount of media M entering into the medium entrance 111, the stopping structure 1231A abuts against the detector 121. Therefore, the second pivoting component 123 can remain at the fourth raised position to actuate the detector 121 to generate a signal which indicates that the large amount of media M enter into the medium entrance 111, but the resilient deformation of the resilient component 124 allows the first pivoting component 122 to pivot to a fifth raised position as shown in FIG. 12 in the first pivoting direction P1 relative to the second pivoting component 123. Such configuration allows a user to place the large amount of media M at the medium entrance 111 for preventing a multi-stage scanning operation or a multi-stage printing operation.

Besides, when all of the media M leave away from the medium entrance 111, the first pivoting component 122 and the second pivoting component 123 can respectively pivot to the first initial position and the second initial position in a second pivoting direction P2 opposite to the first pivoting direction P1 by the resilient component 124 and gravity for a next scanning operation or a next printing operation.

In contrast to the prior art, in the present invention, when the at least one medium enters into the medium entrance and abuts against the abutting end of the first pivoting component, the at least one medium drives the first pivoting component to pivot in the first pivoting direction to drive the second pivoting component to pivot in the first pivoting component by the resilient component for allowing the detecting end of the second pivoting component to actuate the detector to generate the signal. When the detecting end of the second pivoting component is stopped from continuously pivoting in the first pivoting direction, the resilient deformation of the resilient component allows the first pivoting component to be driven by the at least one medium to continuously pivot in the first pivoting direction relative to the second pivoting component. Therefore, the present invention can solve a problem of structural interference in the prior art and allow a user to place a large amount of the media at the medium entrance for preventing a multi-stage scanning or a multi-stage printing operation.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An image forming device capable of detecting at least one medium, the image forming device comprising:

a casing, a medium entrance being formed on the casing; and a medium detecting mechanism disposed adjacent to the medium entrance, the medium detecting mechanism comprising:

a detector disposed inside the casing;

a first pivoting component pivotally disposed on the casing, the first pivoting component comprising an abutting end for abutting against the at least one medium entering into the medium entrance;

a second pivoting component movably sleeved on the first pivoting component, the second pivoting component comprising a detecting end fixedly connected to a body of the second pivoting component and for actuating the detector to generate a signal; and a resilient component connected to the first pivoting component and the second pivoting component, when the at least one medium enters into the medium entrance and abuts against the abutting end, the at least one medium driving the first pivoting component to pivot in a first pivoting direction, when the first pivoting component pivots in the first pivoting direction, the first pivoting component driving the second pivoting component to pivot in the first pivoting direction by the resilient component to drive the detecting end of the second pivoting component to move in the first pivoting direction, so that the detecting end of the second pivoting component moving in the first pivoting direction actuates the detector for generating the signal, and when the detecting end of the second pivoting component is stopped from continuously pivoting in the first pivoting direction, resilient deformation of the resilient component allowing the first pivoting component to be driven by the at least one medium to continuously pivot in the first pivoting direction relative to the second pivoting component.

2. The image forming device of claim 1, wherein a first connecting lug is formed on the first pivoting component, a second connecting lug is formed on the second pivoting component, and the resilient component is connected to the first connecting lug and the second connecting lug.

3. The image forming device of claim 2, wherein a restraining protrusion is formed on the first pivoting component, a restraining slot is formed on the second pivoting component, and the restraining protrusion is movably located in the restraining slot for restraining a pivoting angle of the first pivoting component relative to the second pivoting component.

4. The image forming device of claim 3, wherein the restraining slot comprises a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

5. The image forming device of claim 4, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

6. The image forming device of claim 2, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

7. The image forming device of claim 1, wherein a restraining protrusion is formed on the first pivoting component, a restraining slot is formed on the second pivoting component, and the restraining protrusion is movably located in the restraining slot for restraining a pivoting angle of the first pivoting component relative to the second pivoting component.

8. The image forming device of claim 7, wherein the restraining slot comprises a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

9. The image forming device of claim 8, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

10. The image forming device of claim 1, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

11. A medium detecting mechanism disposed adjacent to a medium entrance formed on a casing of an image forming device, the medium detecting mechanism comprising:

a detector disposed inside the casing;

a first pivoting component pivotally disposed on the casing, the first pivoting component comprising an abutting end for abutting against the at least one medium entering into the medium entrance;

a second pivoting component movably sleeved on the first pivoting component, the second pivoting component comprising a detecting end fixedly connected to a body of the second pivoting component and for actuating the detector to generate a signal; and a resilient component connected to the first pivoting component and the second pivoting component, when the at least one medium enters into the medium entrance and abuts against the abutting end, the at least one medium driving the first pivoting component to pivot in a first pivoting direction, when the first pivoting component pivots in the first pivoting direction, the first pivoting component driving the second pivoting component to pivot in the first pivoting direction by the resilient component to drive the detecting end of the second pivoting component to move in the first pivoting direction, so that the detecting end of the second pivoting component moving in the first pivoting direction actuates the detector for generating the signal, and when the detecting end of the second pivoting component is stopped from continuously pivoting in the first pivoting direction, resilient deformation of the resilient component allowing the first pivoting component to be driven by the at least one medium to continuously pivot in the first pivoting direction relative to the second pivoting component.

12. The medium detecting mechanism of claim 11, wherein a first connecting lug is formed on the first pivoting component, a second connecting lug is formed on the second pivoting component, and the resilient component is connected to the first connecting lug and the second connecting lug.

13. The medium detecting mechanism of claim 12, wherein a restraining protrusion is formed on the first pivoting component, a restraining slot is formed on the second pivoting component, and the restraining protrusion is movably located in the restraining slot for restraining a pivoting angle of the first pivoting component relative to the second pivoting component.

14. The medium detecting mechanism of claim 13, wherein the restraining slot comprises a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

15. The medium detecting mechanism of claim 14, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

16. The medium detecting mechanism of claim 12, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

17. The medium detecting mechanism of claim 11, wherein a restraining protrusion is formed on the first pivoting component, a restraining slot is formed on the second pivoting component, and the restraining protrusion is movably located in the restraining slot for restraining a pivoting angle of the first pivoting component relative to the second pivoting component.

18. The medium detecting mechanism of claim 17, wherein the restraining slot comprises a first restraining wall and a second restraining wall, and when the first pivoting component pivots in the first pivoting direction relative to the second pivoting component by the resilient deformation of the resilient component, the restraining protrusion leaves from the first restraining wall and moves toward the second restraining wall.

19. The medium detecting mechanism of claim 18, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

20. The medium detecting mechanism of claim 11, wherein a stopping structure protrudes from the detecting end, the second pivoting component is stopped from continuously pivoting in the first pivoting direction by abutment of the stopping structure and the detector, and when the stopping structure abuts against detector to stop the second pivoting component from continuously pivoting in the first pivoting direction, the resilient deformation of the resilient component allows the first pivoting component to be driven by the at least one medium to continuously pivot in the first pivoting component relative to the second pivoting component.

* * * * *